US009033732B2

(12) United States Patent
Hashiguchi

(10) Patent No.: US 9,033,732 B2
(45) Date of Patent: May 19, 2015

(54) COAXIAL CONNECTOR AND CONNECTOR UNIT

(71) Applicant: Japan Aviation Electronics Industry, Limited, Tokyo (JP)

(72) Inventor: Osamu Hashiguchi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 37 days.

(21) Appl. No.: 14/022,454

(22) Filed: Sep. 10, 2013

(65) Prior Publication Data

US 2014/0106581 A1 Apr. 17, 2014

(30) Foreign Application Priority Data

Oct. 17, 2012 (JP) ..... 2012-229921

(51) Int. Cl.

| | |
|---|---|
| ***H01R 9/05*** | (2006.01) |
| ***H01R 12/77*** | (2011.01) |
| ***H01R 4/18*** | (2006.01) |
| ***H01R 24/40*** | (2011.01) |
| *H01R 12/59* | (2011.01) |
| *H01R 24/50* | (2011.01) |

(52) U.S. Cl.

CPC ..... *H01R 12/77* (2013.01); *H01R 4/182* (2013.01); *H01R 12/594* (2013.01); *H01R 24/40* (2013.01); *H01R 24/50* (2013.01)

(58) Field of Classification Search

USPC ..... 439/63, 77, 578, 579, 581

IPC ..... H01R 12/594,12/613, 12/77, 12/771, H01R 9/05

See application file for complete search history.

(56) References Cited

U.S. PATENT DOCUMENTS

| | | | | |
|---|---|---|---|---|
| 6,670,552 | B2 * | 12/2003 | Kuroda et al. | 174/59 |
| 6,739,907 | B2 * | 5/2004 | Kuroda et al. | 439/582 |
| 6,790,082 | B2 | 9/2004 | Obayashi | |
| 6,971,913 | B1 * | 12/2005 | Chu | 439/582 |
| 7,217,156 | B2 * | 5/2007 | Wang | 439/579 |
| 8,096,828 | B2 * | 1/2012 | Ellis et al. | 439/578 |
| 8,747,153 | B2 * | 6/2014 | Takano et al. | 439/582 |
| 2014/0073179 | A1 * | 3/2014 | Hashiguchi | 439/581 |
| 2014/0094061 | A1 * | 4/2014 | Chen et al. | 439/578 |

FOREIGN PATENT DOCUMENTS

| | | | | |
|---|---|---|---|---|
| JP | 2002-324636 A | | 11/2002 | |
| JP | 2011-249206 A | | 12/2011 | |
| JP | 2011249206 | * | 12/2011 | H01B 11/00 |

OTHER PUBLICATIONS

English translation of the relevant parts of a Korean Office Action dated Jul. 15, 2014 in KR 10-2013-0108289.

* cited by examiner

*Primary Examiner* — Vanessa Girardi

(74) *Attorney, Agent, or Firm* — Collard & Roe, P.C.

(57) ABSTRACT

A coaxial connector is adapted to hold a connection object having a ground conductor and a signal conductor and is adapted to be fitted to a mating connector. The coaxial connector has a shell for holding the connection object. The shell comprises a first shell portion having a barrel-shaped shell contact portion, a second shell portion having shell connecting portions, positioning portions for positioning the connection object so that a contact portion of the signal conductor of the connection object is located inside the barrel-shaped shell contact portion as seen in a fitting direction of the coaxial connector and the mating connector, and fixing portions for fixing the connection object.

9 Claims, 11 Drawing Sheets

COAXIAL CONNECTOR AND CONNECTOR UNIT

This application is based upon and claims the benefit of priority from Japanese patent application No. 2012-229921, filed on Oct. 17, 2012, the disclosure of which is incorporated herein in its entirety by reference.

BACKGROUND OF THE INVENTION

1. Field of the Invention

This invention relates to a coaxial connector and a connector unit and in particular, relates to a coaxial connector that can be used for connecting a connection object having a flat plate portion.

2. Description of Related Art

As shown in FIG. 1, there is known a coaxial connector 110 comprising a connection terminal 120 adapted to be connected to an inner conductor 151 of a coaxial cable 150, a metal shell 130 adapted to be connected to an outer conductor 152 of the coaxial cable 150, and an insulating portion 140 interposed between the connection terminal 120 and the shell 130 (see, e.g. JP-A-2002-324636). In FIG. 1, numeral 153 denotes an outer jacket of the coaxial cable 150 while numeral 154 denotes an insulator of the coaxial cable 150.

SUMMARY OF THE INVENTION

With the coaxial connector 110 of JP-A-2002-324636, however, there has been a problem that when connecting the coaxial cable 150 to the coaxial connector 110, the connecting operation of the outer conductor (shield wire) 152 of the coaxial cable 150 is complicated, thus leading to an increase in the number of assembly steps.

Further, with the coaxial connector 110 of JP-A-2002-324636, there has been a problem that since the connection terminal 120 for contact with a mating contact (not illustrated) of a mating connector (not illustrated) is provided, the number of components increases corresponding to this connection terminal 120, thus leading to an increase in the manufacturing cost of the coaxial connector 110 and hindering the miniaturization of the coaxial connector 110.

Therefore, this invention is intended to solve the above-mentioned conventional problems, i.e. it is an object of this invention to provide a coaxial connector capable of reducing the number of components, the manufacturing cost, and the number of assembly steps and achieving the miniaturization thereof and further to provide a connector unit comprising such a coaxial connector.

In order to solve the above-mentioned problem, there is provided, according to the present invention, a coaxial connector which is adapted to be fitted to a mating connector while holding a connection object having a ground conductor and a signal conductor which is disposed on a front surface of a flat plate portion of the connection object, thereby achieving electrical connection between the connection object and the mating connector, and the coaxial connector comprising a conductive shell for holding the connection object, wherein the shell comprises: a first shell portion having a shell contact portion of a hollow cylindrical or prism shape for contact with a mating shell of the mating connector; a second shell portion having a shell connecting portion for connection to the ground conductor of the connection object; a positioning portion for positioning the connection object so that a contact portion of the signal conductor of the connection object is located inside the shell contact portion as seen in a fitting direction of the coaxial connector and the mating connector; and a fixing portion for fixing the connection object.

DESCRIPTION OF THE EXEMPLARY EMBODIMENTS

Hereinbelow, embodiments of this invention will be described with reference to the drawings.

Figure 1:
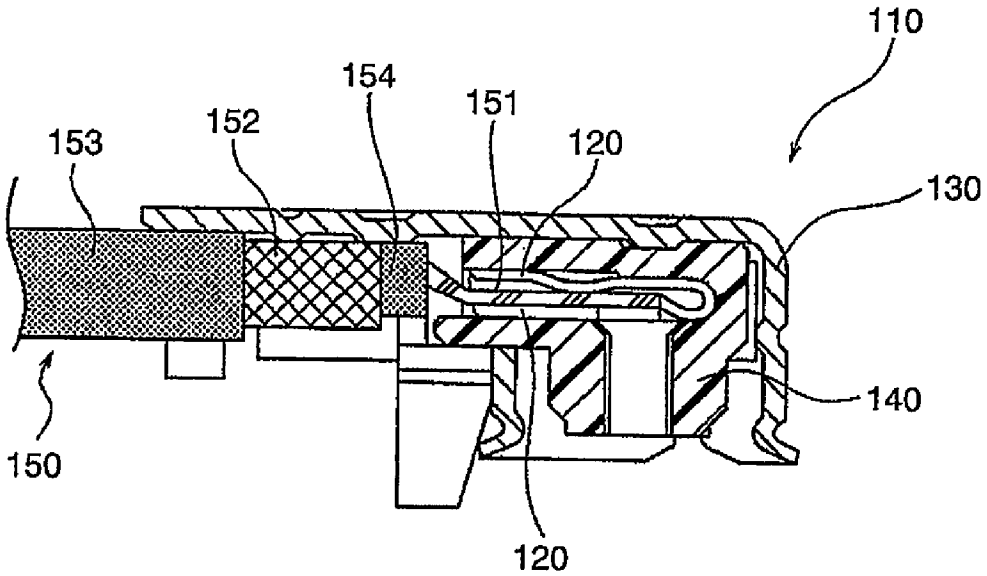
FIG. 1 PRIOR ART
FIG. 1 is an explanatory diagram showing a related coaxial connector.
Figure 2:
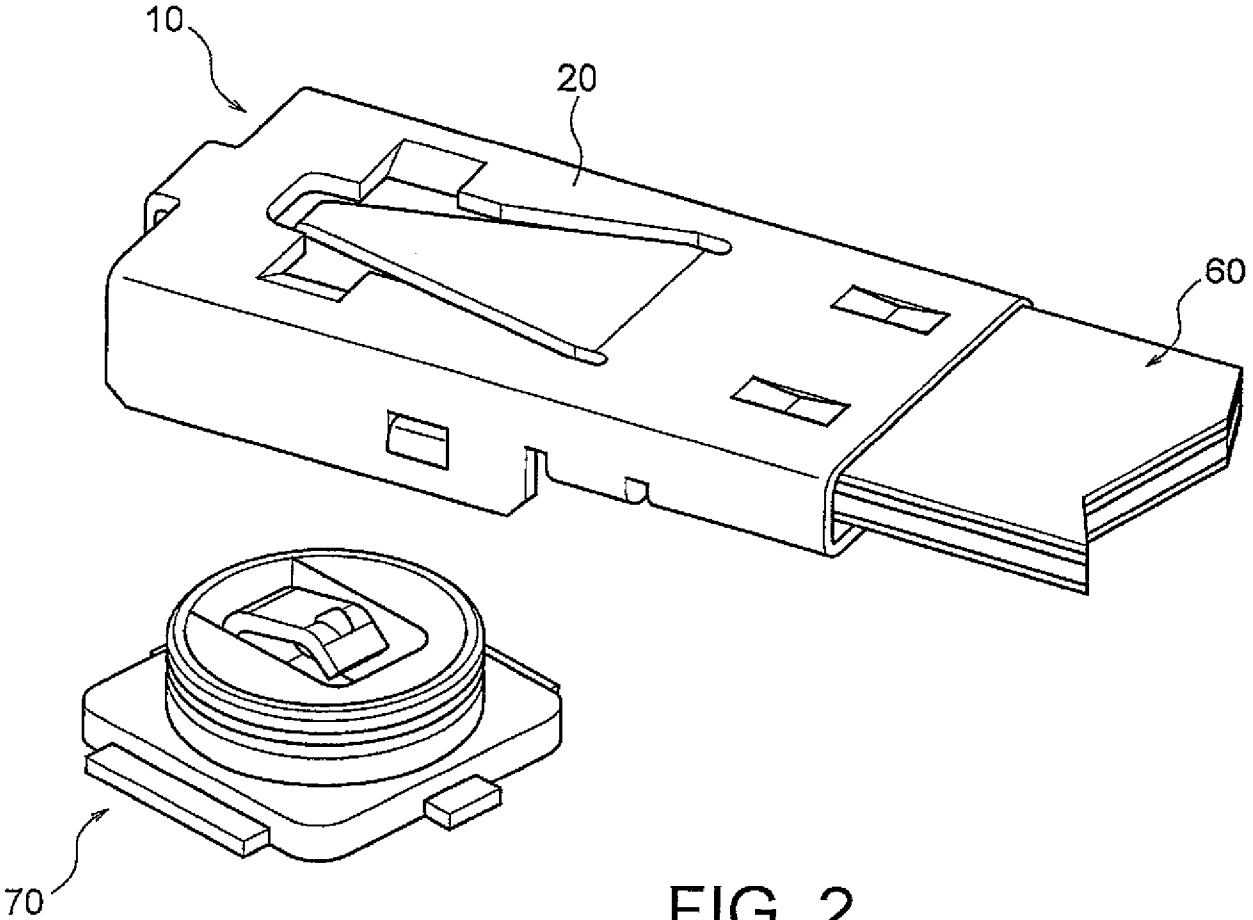
FIG. 2 is a perspective view showing the manner of use of a coaxial connector of a first embodiment of this invention.

As shown in FIG. 2, while holding an FPC (flexible printed circuit) 60 as a connection object, a coaxial connector 10 according to a first embodiment of this invention is adapted to be fitted to a mating connector 70, thereby achieving electrical connection between the FPC 60 and the mating connector 70.

Figure 3:
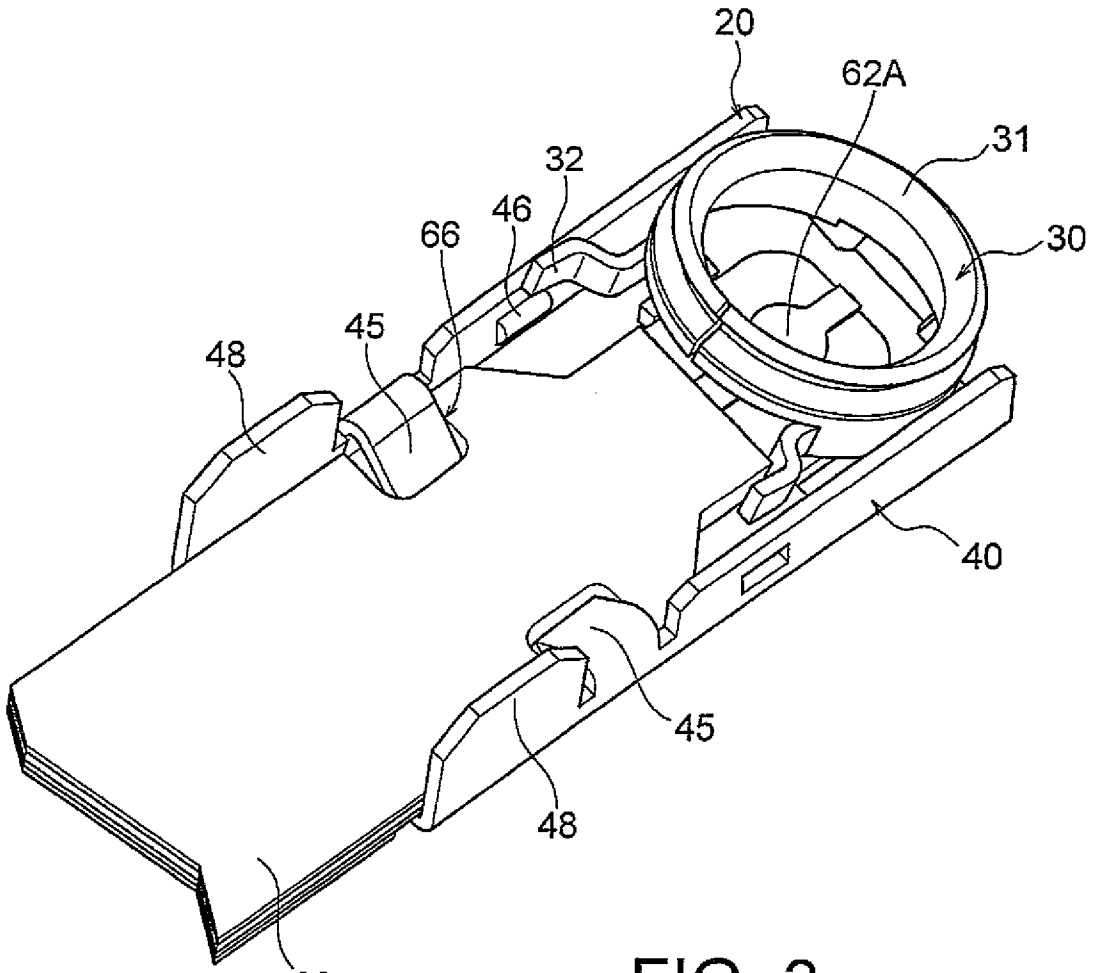
FIG. 3 is a perspective view showing an intermediate stage of attachment of a connection object to the coaxial connector.

As shown in FIGS. 2 and 3, the coaxial connector 10 comprises a conductive shell 20 for holding the FPC 60.

Figure 5:
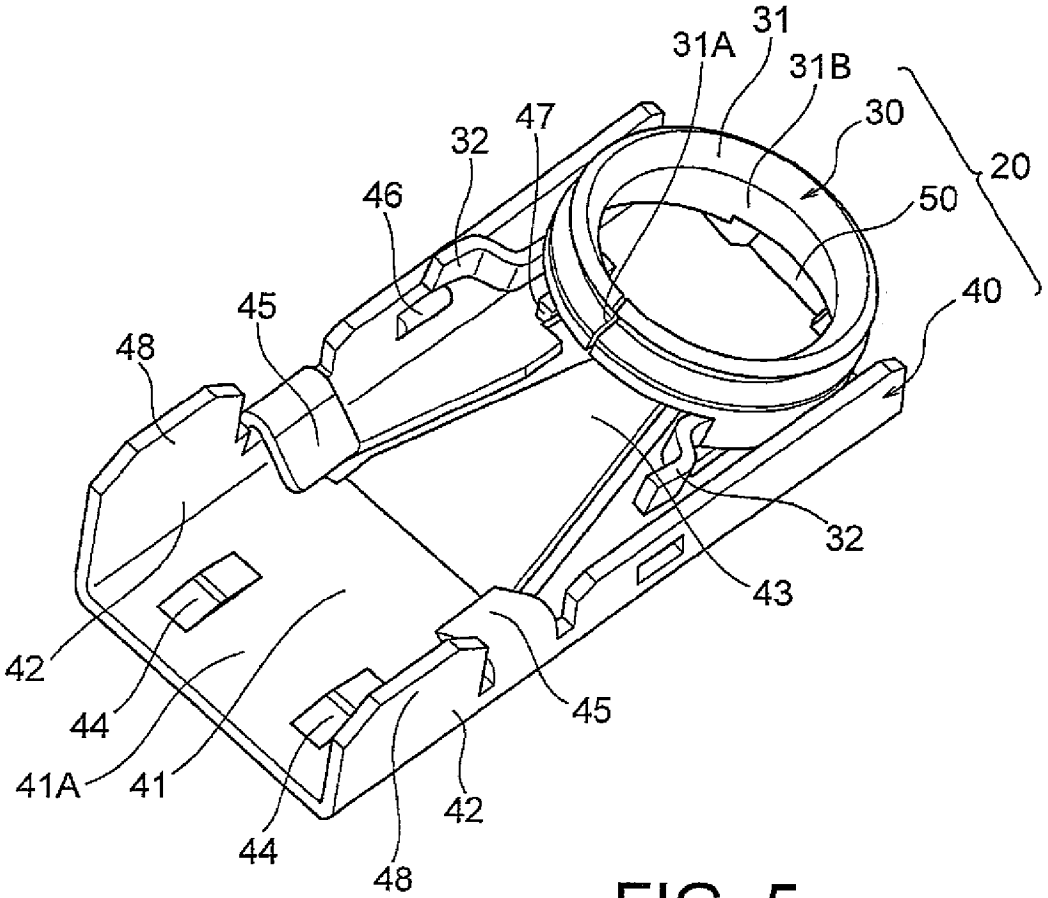
FIG. 5 is a perspective view showing a shell forming the coaxial connector.

The shell 20 is formed of a conductive metal and, as shown in FIG. 5, comprises a first shell portion 30, a second shell portion 40, and a coupling portion 50 coupling together the first shell portion 30 and the second shell portion 40, which are integrally formed together.

As shown in FIG. 5, the first shell portion 30 of the shell 20 has a barrel-shaped shell contact portion 31 for contact with a mating shell 72 (see FIG. 7) of the mating connector 70 and a pair of first locking portions 32 for fixing the first shell portion 30 to the second shell portion 40.

As shown in FIG. 5, the shell contact portion 31 is formed with a slit portion 31A. By forming this slit portion 31A, the springiness is imparted to the shell contact portion 31. Specifically, the barrel-shaped shell contact portion 31 once expands due to a mating fitting portion 72C (see FIG. 7) of the mating shell 72 when fitting the coaxial connector 10 to the mating connector 70 and then returns to its initial shape when the fitting to the mating connector 70 has been completed. In this manner, the springiness is imparted to the shell contact portion 31. Further, as shown in FIG. 5, the shell contact portion 31 is formed at its inner periphery with a fitting portion 31B which is adapted to be fitted to the mating fitting portion 72C of the mating shell 72 when the coaxial connector 10 is fitted to the mating connector 70.

Figure 4:
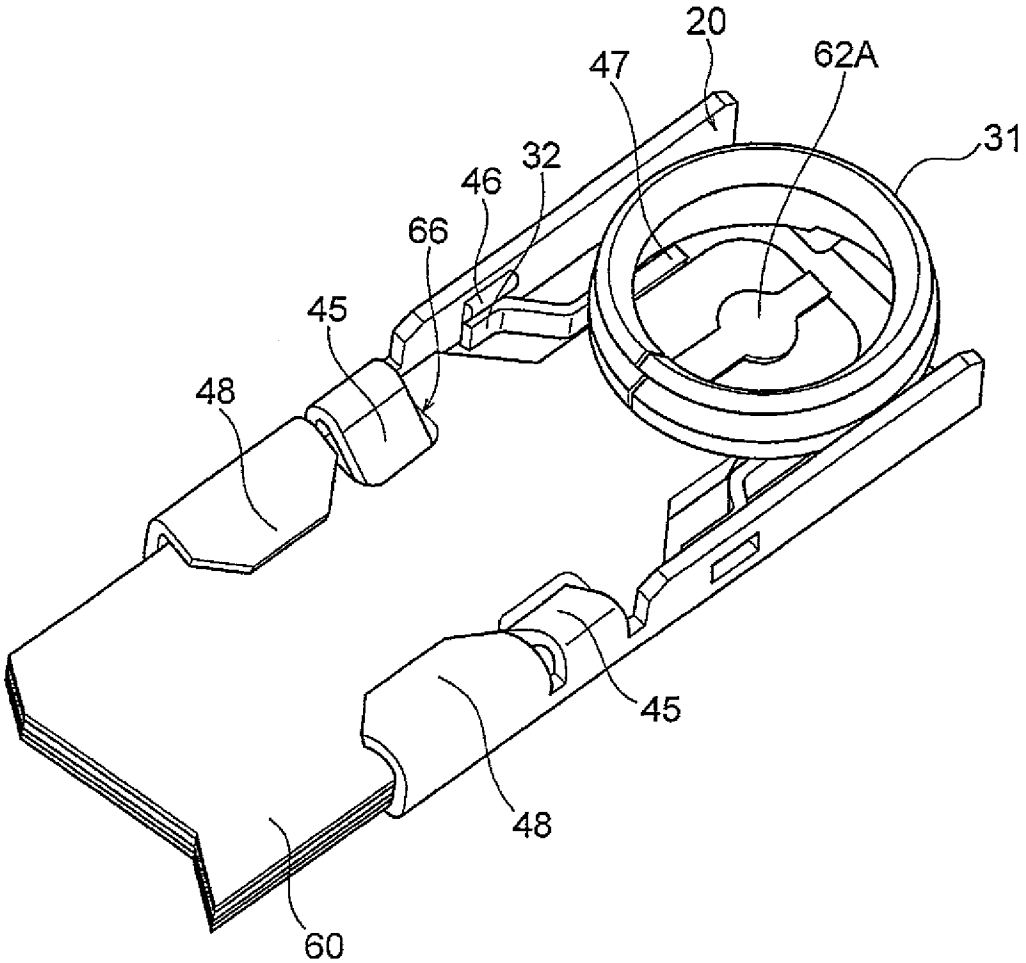
FIG. 4 is a perspective view showing a state where the attachment of the connection object to the coaxial connector has been completed.

As shown in FIG. 4, the first locking portions 32 are each adapted to engage with a corresponding one of a pair of second locking portions 46 of the second shell portion 40, thereby fixing the first shell portion 30 (shell contact portion 31) to the second shell portion 40. In this manner, the first locking portions 32 and the second locking portions 46 form fixing means for fixing the shell contact portion 31 to the second shell portion 40.

As shown in FIG. 5, the second shell portion 40 of the shell 20 has a body portion 41, a pair of side wall portions 42, a first spring portion 43, a pair of second spring portions 44, a pair of engaging portions 45, the pair of second locking portions 46, at least one projecting portion 47, and a pair of fixing portions 48.

The body portion 41 is a plate-like portion for placing the FPC 60 on its upper surface in the figure. As shown in FIG. 5, the side wall portions 42 are plate-like portions formed perpendicular to the body portion 41 on both sides in a width direction of the body portion 41.

As shown in FIG. 5, the first spring portion 43 is supported in a cantilevered manner by the body portion 41 so as to be elastically deformable in a fitting direction in which the coaxial connector 10 and the mating connector 70 are fitted together. When the coaxial connector 10 holding the FPC 60 at a predetermined position and the mating connector 70 are fitted together, the first spring portion 43 pushes the FPC 60, placed on its upper surface in the figure, toward the mating connector 70. Consequently, a contact portion 62A (see FIG. 6) of the FPC 60 and a signal contact portion 71A (see FIG. 7) of the mating connector 70 can be surely brought into contact with each other. The first spring portion 43 is formed at a position so as to be brought into contact with a ground connecting portion 63A (see FIG. 6) of the FPC 60 when the FPC 60 is attached to the coaxial connector 10 at the predetermined position. Accordingly, the first spring portion 43 serves also as a shell connecting portion for connection to a ground conductor 63 (see FIG. 6) of the FPC 60.

As shown in FIG. 5, the second spring portions 44 are formed on the body portion 41. The second spring portions 44 are adapted to push the ground conductor 63 of the FPC 60 upward in the figure when the FPC 60 placed on the shell 20 is fixed by the fixing portions 48. The second spring portions 44 are formed at positions corresponding to the fixing portions 48, respectively. Consequently, the shell 20 and the ground conductor 63 of the FPC 60 can be surely brought into contact with each other. In this manner, the second spring portions 44 serve also as shell connecting portions for connection to the ground conductor 63 of the FPC 60. The second spring portions 44 may be omitted. In this case, a portion 41A of the body portion 41 serves as a shell connecting portion.

As shown in FIG. 5, the engaging portions 45 are respectively formed at the side wall portions 42. The engaging portions 45 are adapted to respectively engage with a pair of cut-out portions 66 (see FIG. 6) of the FPC 60. Specifically, as shown in FIGS. 3 and 4, the engaging portions 45 enter the cut-out portions 66 of the FPC 60 and engage with the FPC 60 in a longitudinal direction of the FPC 60 in the state where the FPC 60 is placed at the predetermined position on the shell 20. Consequently, the engaging portions 45 inhibit movement of the FPC 60 in its longitudinal direction to thereby prevent the FPC 60 from coming off the shell 20 and further achieve positioning of the FPC 60 relative to the shell 20. In this manner, the engaging portions 45 serve also as positioning portions for positioning the FPC 60 relative to the shell 20.

As shown in FIG. 5, the second locking portions 46 are respectively formed at the side wall portions 42. The second locking portions 46 are adapted to respectively engage with the first locking portions 32, thereby fixing together the first shell portion 30 and the second shell portion 40.

As shown in FIG. 5, the at least one projecting portion 47 is formed on the body portion 41. The projecting portion 47 serves to guide the FPC 60 when attaching the FPC 60 to the shell 20 and to achieve positioning of the FPC 60 after attaching the FPC 60 to the shell 20 (particularly, positioning of the contact portion 62A of the FPC 60). If a pair of projecting portions 47 are formed and sandwich therebetween a flat plate portion 61 (see FIG. 6) of the FPC 60 in its width direction (direction perpendicular to the longitudinal direction of the FPC 60), the positioning of the contact portion 62A of the FPC 60 can be carried out more reliably.

As shown in FIG. 5, the fixing portions 48 are respectively formed at the side wall portions 42. The fixing portions 48 are adapted to fix the FPC 60 to the shell 20. Specifically, as shown in FIG. 4, the fixing portions 48 are caulked (bent) after the FPC 60 is placed at the predetermined position on the shell 20 so that free end sides of the fixing portions 48 partially cover the front surface side of the flat plate portion 61 of the FPC 60, thereby fixing the FPC 60 to the shell 20.

Figure 6:
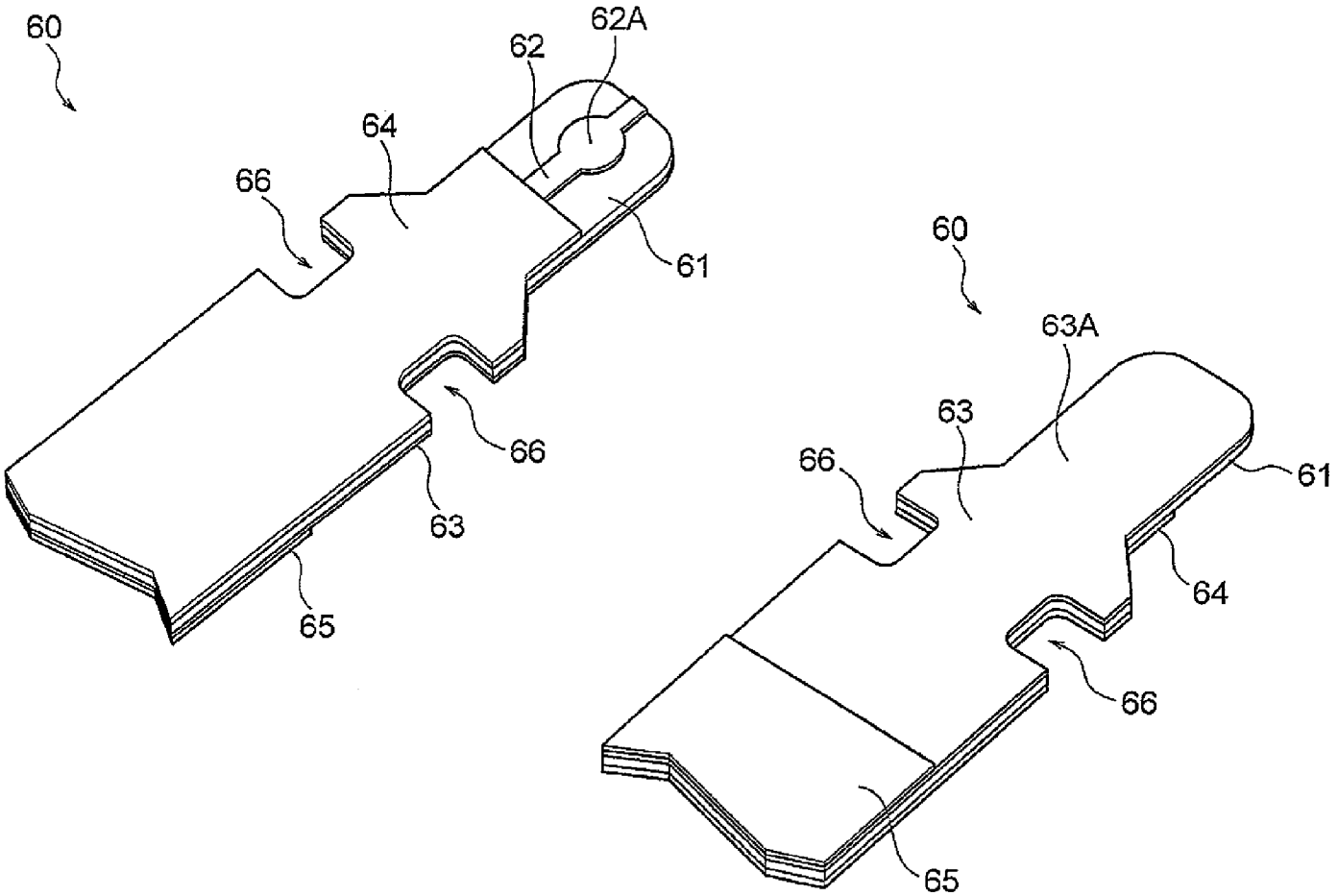
FIG. 6 is an explanatory diagram showing the connection object.

As shown in FIG. 6, the FPC 60 has the insulating flat plate portion 61 formed in an elongated thin plate shape, a signal conductor 62 formed in a planar shape (thin film shape) on the front surface side of the flat plate portion 61, the ground conductor 63 formed in a planar shape on the back surface side of the flat plate portion 61, a front side insulating layer 64 formed on the front surface side of the flat plate portion 61 so as to partially cover the signal conductor 62, a back side insulating layer 65 formed on the back surface side of the flat plate portion 61 so as to partially cover the ground conductor 63, and the cut-out portions 66 formed on both sides in the width direction of the FPC 60.

As shown in FIG. 6, the signal conductor 62 has the contact portion 62A for contact with a mating contact 71 (see FIG. 7) of the mating connector 70. The contact portion 62A is not covered with the front side insulating layer 64 and is exposed to the outside.

As shown in FIG. 6, the ground conductor 63 has the ground connecting portion 63A for connection to the shell connecting portions (in this embodiment, the first spring portion 43 and the second spring portions 44) of the shell 20. The ground connecting portion 63A is not covered with the back side insulating layer 65 and is exposed to the outside.

The mating connector 70 is a receptacle connector adapted to be mounted on a printed board (not illustrated), an FPC (not illustrated), or the like and adapted to be fitted to and electrically connected to the coaxial connector 10 as a plug connector.

Figure 7:
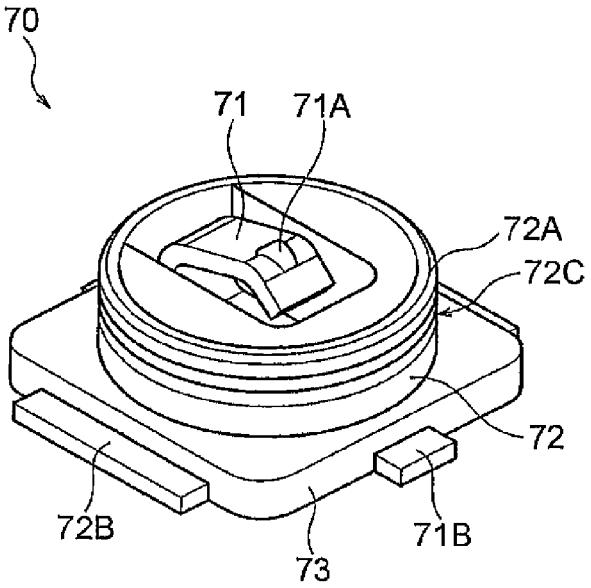
FIG. 7 is a perspective view showing a mating connector.
Figure 8:
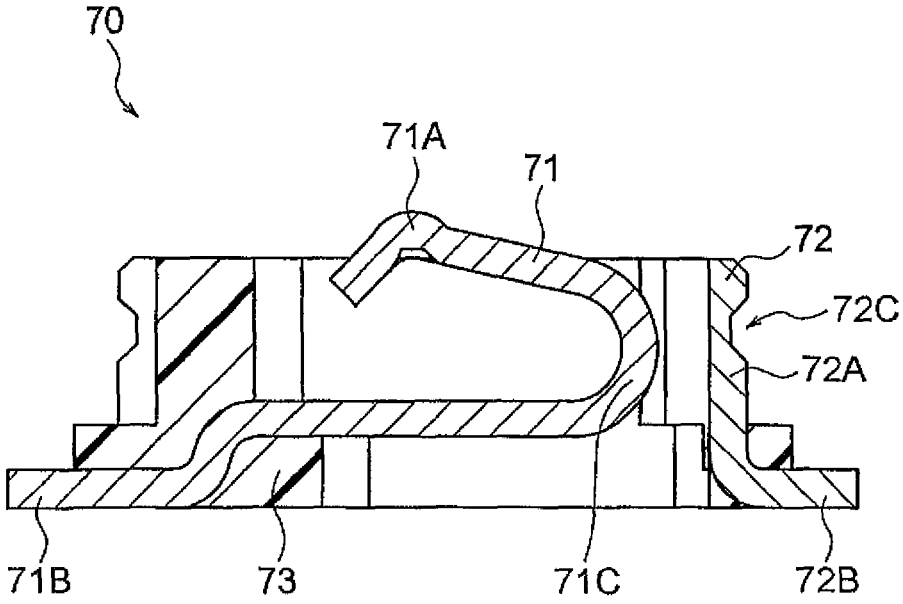
FIG. 8 is a cross-sectional view of the mating connector.

As shown in FIGS. 7 and 8, the mating connector 70 comprises the conductive mating contact 71 adapted to be connected to the signal conductor 62 of the FPC 60, the conductive mating shell 72 adapted to be connected to the shell 20 of the coaxial connector 10, and an insulating mating housing 73 holding the mating contact 71 and the mating shell 72 and insulating them from each other. The mating shell 72 surrounds the mating contact 71 at least partially.

As shown in FIGS. 7 and 8, the mating contact 71 has the signal contact portion 71A for contact with the contact portion 62A of the FPC 60, a signal connecting portion 71B adapted to be connected to an electrode pad (not illustrated) of the printed board, the FPC, or the like by soldering or the like, and a spring portion 71C formed between the signal contact portion 71A and the signal connecting portion 71B.

Figure 9:
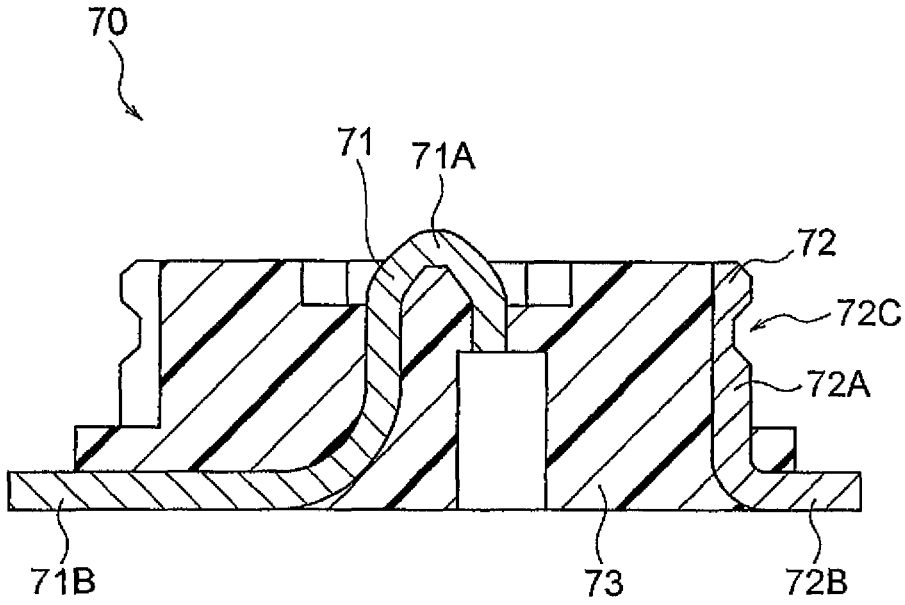
FIG. 9 is a cross-sectional view showing a modification of the mating connector.

In this embodiment, as shown in FIG. 8, since the mating contact 71 has the spring portion 71C, the signal contact portion 71A elastically deforms in the fitting direction of the coaxial connector 10 and the mating connector 70 when these connectors are fitted together. However, as described above, the contact reliability between the contact portion 62A of the FPC 60 and the signal contact portion 71A of the mating connector 70 is ensured by the first spring portion 43 of the shell 20. Therefore, as shown in FIG. 9, a mating contact 71 may have no spring portion 71C and a signal contact portion 71A of the mating contact 71 may be fixed to a mating housing 73.

As shown in FIGS. 7 and 8, the mating shell 72 has a ground contact portion 72A for contact with the shell contact portion 31 of the shell 20 and ground connecting portions 72B adapted to be connected to electrical pads (not illustrated) of the printed board, the FPC, or the like by soldering or the like. The ground contact portion 72A is formed at its outer periphery with the mating fitting portion 72C having a shape conforming to the fitting portion 31B (see FIG. 5) of the shell contact portion 31 of the shell 20.

Next, a method of attaching the FPC 60 to the coaxial connector 10 will be described hereinbelow.

First, as shown in FIG. 3, the FPC 60 is inserted and placed with respect to the shell 20 in the state where the first locking portions 32 and the second locking portions 46 are not engaged with each other so that the first shell portion 30 is slightly spaced apart from the second shell portion 40.

Specifically, the FPC 60 is inserted with respect to the shell 20 so that the engaging portions 45 of the shell 20 enter the cut-out portions 66 of the FPC 60 and further that a forward end portion of the FPC 60 enters between the first shell portion 30 and the second shell portion 40 (between the shell contact portion 31 and the first spring portion 43). In this event, the side wall portions 42, the projecting portion 47, the fixing portions 48, and so on of the shell 20 serve as guide portions for guiding the FPC 60.

In the state where the FPC 60 is inserted and placed with respect to the shell 20, the FPC 60 is positioned by the shell 20 so that the contact portion 62A of the FPC 60 is located inside the barrel-shaped shell contact portion 31 as seen in the fitting direction of the coaxial connector 10 and the mating connector 70. In this embodiment, the side wall portions 42, the engaging portions 45, the projecting portion 47, the fixing portions 48, and so on of the shell 20 serve as positioning portions for positioning the FPC 60. Such positioning portions may have any specific configuration as long as it can properly serve to position the FPC 60 (particularly the contact portion 62A).

Herein, in the state where the FPC 60 is positioned relative to the shell 20, the shell 20 and the signal conductor 62 (contact portion 62A) of the FPC 60 are insulated from each other by the insulating flat plate portion 61 and the front side insulating layer 64 of the FPC 60 such that, for example, the front side insulating layer 64 is interposed between the barrel-shaped shell contact portion 31 and the signal conductor 62.

Finally, as shown in FIG. 4, the first locking portions 32 and the second locking portions 46 are engaged with each other and the fixing portions 48 are caulked, thereby fixing the FPC 60 to the shell 20.

In the above description, as shown in FIG. 3, the attachment of the FPC 60 to the coaxial connector 10 is started in the state where the first locking portions 32 and the second locking portions 46 are not engaged with each other so that the first shell portion 30 is slightly spaced apart from the second shell portion 40. However, the FPC 60 may be inserted with respect to the coaxial connector 10 in the state where the first locking portions 32 and the second locking portions 46 are engaged with each other in advance so that the first shell portion 30 is fixed to the second shell portion 40.

Next, a method of connecting the mating connector 70 to the coaxial connector 10 holding the FPC 60 at the predetermined position will be described hereinbelow with reference to FIGS. 2, 4, 5, and 7.

First, as shown in FIG. 2, in the state where the signal contact portion 71A of the mating connector 70 and the contact portion 62A of the FPC 60 face each other, the barrel-shaped shell contact portion 31 of the shell 20 is fitted to the mating connector 70.

In this event, since the slit portion 31A is formed in the barrel-shaped shell contact portion 31, the barrel-shaped shell contact portion 31 once expands due to insertion of the mating connector 70 and then, when the fitting portion 31B of the shell contact portion 31 and the mating fitting portion 72C of the mating shell 72 are fitted together, the barrel-shaped shell contact portion 31 returns to its initial shape.

In this manner, the coaxial connector 10 and the mating connector 70 can be connected together by the single operation, i.e. the insertion of the mating connector 70 into the shell contact portion 31.

According to the coaxial connector 10 of this embodiment thus obtained, the connecting operation of the shield wire of the coaxial cable, which is required in the related art described before, is not required when attaching the FPC 60 to the coaxial connector 10 and, therefore, it is possible to reduce the number of assembly steps.

Further, since the contact portion 62A of the FPC 60 held by the shell 20 is used as the contact for contact with the mating contact 71, it is not necessary to separately provide a contact for connection between the signal conductor 62 of the FPC 60 and the mating contact 71. Therefore, it is possible to reduce the number of components and the manufacturing cost of the coaxial connector 10 and thus to achieve the miniaturization thereof.

Further, since the engaging portions 45 of the shell 20 have both the function of preventing the FPC 60 from coming off the shell 20 and the function of positioning the FPC 60 relative to the shell 20, it is possible to simplify the structure of the shell 20.

Further, since the planar contact portion 62A of the FPC 60 and the signal contact portion 71A of the mating connector 70 are brought into contact with each other using the first spring portion 43 of the shell 20, it is possible to achieve a reduction in the height of the coaxial connector 10 in the fitting direction of the coaxial connector 10 and the mating connector 70.

Further, since the first spring portion 43 of the shell 20 serves also as the shell connecting portion for connection to the ground conductor 63 of the FPC 60, it is possible to reduce the number of connection steps and further to simplify the structure of the shell 20.

Further, since the flat plate portion 61 and the front side insulating layer 64 of the FPC 60 can be used as the insulators for insulating the shell 20 and the signal conductor 62 of the FPC 60 from each other, it is not necessary to separately provide an insulator for insulation between the shell 20 and the signal conductor 62 of the FPC 60.

Next, a second embodiment of this invention will be described with reference to FIGS. 10 and 11. Hereinbelow, only the difference between the first embodiment and the second embodiment will be described. Components having the same functions as in the first embodiment are assigned the same reference symbols as in the first embodiment.

Herein, the first embodiment and the second embodiment mainly differ from each other in method of fixing the FPC 60 to the shell 20. Specifically, in the first embodiment, as shown in FIGS. 3 and 4, after the FPC 60 is placed on the shell 20, the fixing portions 48 of the shell 20 are caulked so that the free end sides of the fixing portions 48 directly cover the FPC 60, thereby fixing the FPC 60 to the shell 20. On the other hand, in the second embodiment, as shown in FIGS. 10 and 11, an FPC 60 is sandwiched between a first shell portion 30 and a second shell portion 40 of a shell 20 and then a pair of fixing portions 48' of the shell 20 are caulked so that free end sides of the fixing portions 48' cover a frame portion 33 of the shell 20, thereby fixing together the first shell portion 30 and the second shell portion 40 so that the FPC 60 is fixed to the shell 20.

Figure 10:
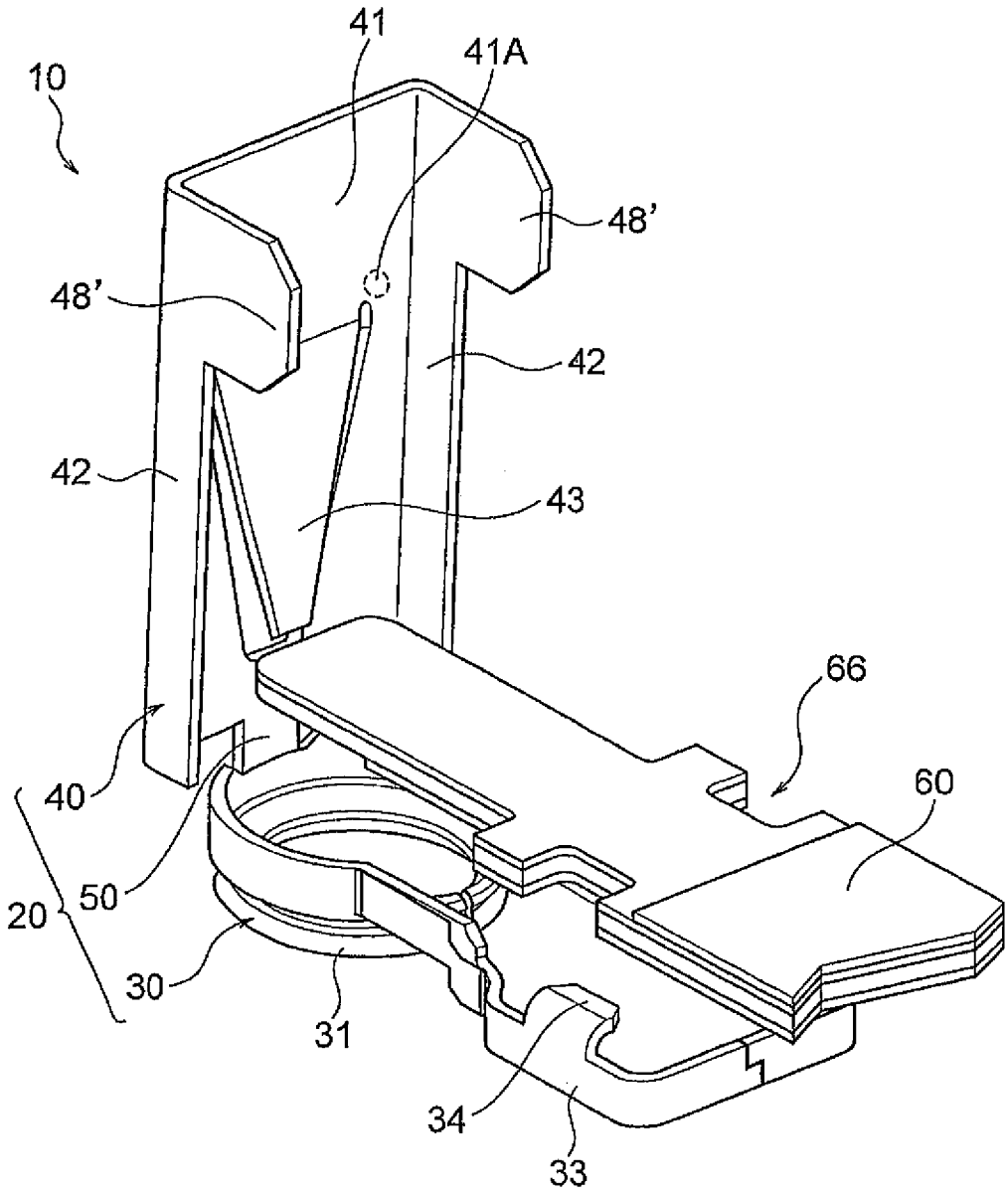
FIG. 10 is a perspective view showing an intermediate stage of attachment of a connection object to a coaxial connector of a second embodiment of this invention.
Figure 11:
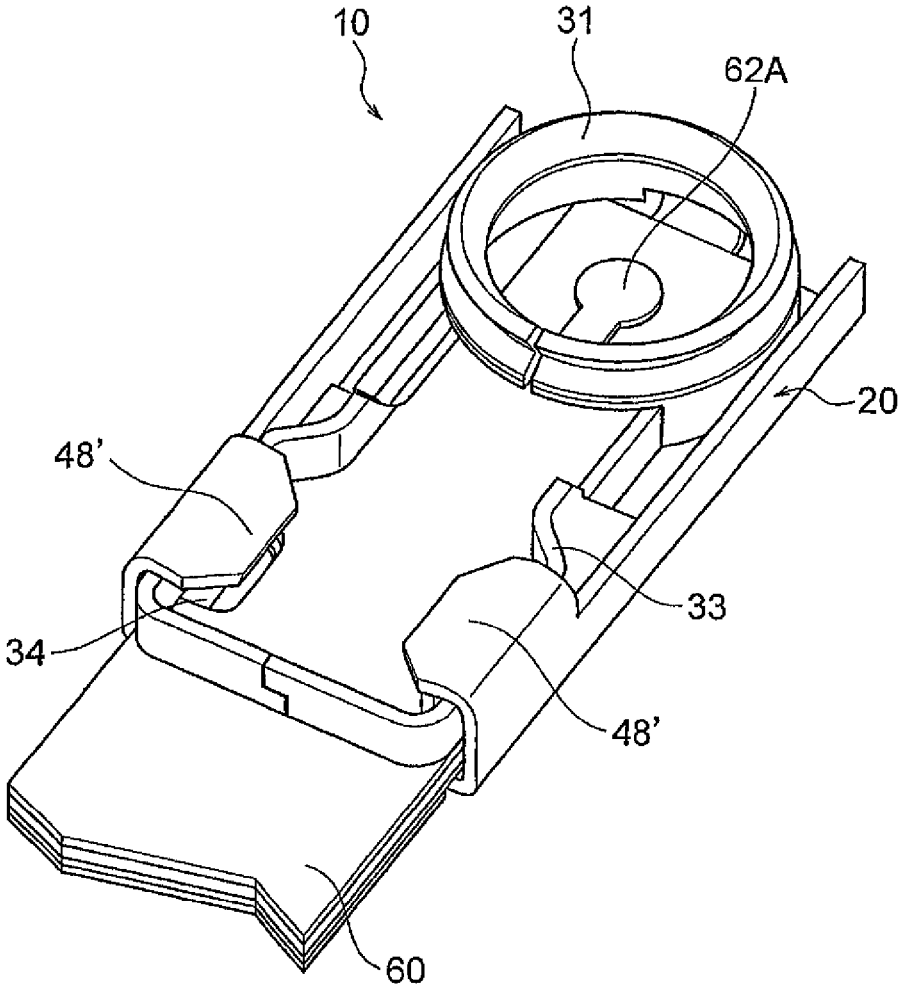
FIG. 11 is a perspective view showing a state where the attachment of the connection object to the coaxial connector of the second embodiment of this invention has been completed.

Specifically, in the second embodiment, as shown in FIGS. 10 and 11, the first shell portion 30 of the shell 20 has a barrel-shaped shell contact portion 31, the frame portion 33 formed continuously from the shell contact portion 31, and a pair of engaging portions 34 formed at the frame portion 33 and adapted to respectively engage with a pair of cut-out portions 66 of the FPC 60. Since the engaging portions 34 serve in the same manner as the engaging portions 45 of the first embodiment, description thereof is omitted.

Further, in the second embodiment, as shown in FIGS. 10 and 11, the second shell portion 40 of the shell 20 has a body portion 41, a pair of side wall portions 42, a first spring portion 43, and the pair of fixing portions 48'. As shown in FIG. 11, the fixing portions 48' are caulked after the FPC 60 is sandwiched between the first shell portion 30 and the second shell portion 40 so that the free end sides of the fixing portions 48' cover the frame portion 33 of the first shell portion 30, thereby fixing together the first shell portion 30 and the second shell portion 40 to fix the FPC 60 to the shell 20.

Also in the second embodiment, as shown in FIG. 10, a coupling portion 50 coupling together the first shell portion 30 and the second shell portion 40 is provided so that the shell 20 is integrally formed as in the first embodiment.

In the second embodiment, the first spring portion 43 and a portion, denoted by symbol 41A in FIG. 10, of the body portion 41 serve as shell connecting portions for connection to a ground conductor 63 of the FPC 60. Further, the fixing portions 48' serve as fixing means for fixing the first shell portion 30 (shell contact portion 31) to the second shell portion 40. Further, the engaging portions 34, the frame portion 33, the side wall portions 42, and so on of the shell 20 serve as positioning portions for positioning the FPC 60 (particularly a contact portion 62A) relative to the shell 20.

In the above-mentioned embodiments, the description has been made assuming that the connection object which is held by the shell of the coaxial connector is the FPC (flexible printed circuit). However, it may be any connection object as long as it has a ground conductor and a signal conductor which is disposed on a surface of a flat plate portion. For example, it may be an FFC (flexible flat cable). Further, while the FPC or FFC whose flat plate portion is thin has been cited above as an example of the connection object, a flat plate portion of a connection object adapted for use in this invention may have any thickness.

In the above-mentioned embodiments, the description has been made assuming that the signal conductor is formed on the front surface side of the connection object (FPC) while the ground conductor is formed on the back surface side of the connection object (FPC). However, the ground conductor may be formed at any position as long as it can ensure smooth connection to the shell. For example, the ground conductor may be formed on the front surface side, where the signal conductor is formed, of the connection object (FPC). In this case, the free ends of the fixing portions 48 of the first embodiment or the frame portion 33 of the second embodiment may serve as a shell connecting portion.

In the above-mentioned embodiments, the first shell portion 30 and the second shell portion 40 are integrated by the coupling portion 50. However, the first shell portion 30 and the second shell portion 40 may be formed separately. In this case, locking portions for locking together the first shell portion 30 and the second shell portion 40 may be respectively provided to the first shell portion 30 and the second shell portion 40 at portions corresponding to the coupling portion 50.

In the above-mentioned embodiments, the shell contact portion 31 and the ground contact portion 72A each have the barrel shape, i.e. the hollow cylindrical shape. However, it may have a hollow polygonal (rectangular, hexagonal, or the like) prism shape.

This invention is not limited to the above-mentioned embodiments and part or the whole thereof can also be described as the following supplementary notes but is not limited thereto.

(Supplementary Note 1)

A coaxial connector 10 adapted to be fitted to a mating connector 70 while holding a connection object 60 having a ground conductor 63 and a signal conductor 62 which is disposed on a front surface of a flat plate portion 61 of the connection object, thereby achieving electrical connection between the connection object and the mating connector 70, the coaxial connector comprising a conductive shell for holding the connection object, wherein the shell 20 comprises:

a first shell portion 30 having a shell contact portion 31 of a hollow cylindrical or prism shape for contact with a mating shell 72 of the mating connector;

a second shell portion 40 having a shell connecting portion 43, 44 for connection to the ground conductor of the connection object;

a positioning portion 42, 45, 47, 48 for positioning the connection object so that a contact portion 62A of the signal conductor of the connection object is located inside the shell contact portion as seen in a fitting direction of the coaxial connector and the mating connector; and a fixing portion 48 for fixing the connection object.

In this invention, the connecting operation of the shield wire of the coaxial cable, which is required in the related art described before, is not required when attaching the connection object to the coaxial connector and, therefore, it is possible to reduce the number of assembly steps.

Further, in this invention, since the contact portion of the signal conductor of the connection object held by the shell is used as a contact for contact with the mating contact of the mating connector, it is not necessary to separately provide a contact for connection between the signal conductor of the connection object and the mating contact of the mating connector. Therefore, it is possible to reduce the number of components and the manufacturing cost of the coaxial connector and thus to achieve the miniaturization thereof.

(Supplementary Note 2)

The coaxial connector according to supplementary note 1, wherein the shell has a fixing portion 32, 46, 48' for fixing the shell contact portion to the second shell portion.

(Supplementary Note 3)

The coaxial connector according to supplementary note 1 or 2, wherein the shell has an engaging portion adapted to engage with the connection object in a direction in which the connection object extends, and wherein the engaging portion serves also as the positioning portion.

(Supplementary Note 4)

The coaxial connector according to any one of supplementary notes 1 to 3, wherein the shell has a spring portion formed at a position which faces a back surface of the flat plate portion of the connection object when the connection object is positioned by the positioning portion, the spring portion adapted to push the contact portion of the signal conductor of the connection object toward a mating contact of the mating connector.

(Supplementary Note 5)

The coaxial connector according to supplementary note 4, wherein the ground conductor of the connection object is disposed on the back surface of the flat plate portion of the connection object, and wherein the spring portion serves also as the shell connecting portion.

(Supplementary Note 6)

The coaxial connector according to any one of supplementary notes 1 to 5, wherein the shell has a coupling portion coupling together the first shell portion and the second shell portion, and wherein the first shell portion, the second shell portion, and the coupling portion are integrally formed together.

(Supplementary Note 7)

The coaxial connector according to any one of supplementary notes 1 to 6, wherein the shell contact portion is formed with a fitting portion for fitting to the mating shell of the mating connector.

(Supplementary Note 8)

A connector unit comprising the coaxial connector according to any one of supplementary notes 1 to 7 and the connection object.

(Supplementary Note 9)

A connector unit comprising the coaxial connector according to any one of supplementary notes 1 to 7 and the mating connector.

While the invention has been particularly shown and described with reference to the exemplary embodiments thereof, the invention is not limited to these embodiments. It will be understood by those of ordinary skill in the art that various changes in form and details may be made therein without departing from the sprit and scope of this invention as defined by the claims.

What is claimed is:

1. A coaxial connector adapted to be fitted to a mating connector while holding a connection object having a ground conductor and a signal conductor which is disposed on a front surface of a flat plate portion of the connection object, thereby achieving electrical connection between the connection object and the mating connector, the coaxial connector comprising a conductive shell for holding the connection object, wherein the shell comprises:

a first shell portion having a shell contact portion of a hollow cylindrical or prism shape for contact with a mating shell of the mating connector;

a second shell portion having a shell connecting portion for connection to the ground conductor of the connection object;

a positioning portion for positioning the connection object so that a contact portion of the signal conductor of the connection object is located inside the shell contact portion as seen in a fitting direction of the coaxial connector and the mating connector; and a fixing portion for fixing the connection object.

2. The coaxial connector according to claim 1, wherein the shell has a spring portion formed at a position which faces a back surface of the flat plate portion of the connection object when the connection object is positioned by the positioning portion, the spring portion adapted to push the contact portion of the signal conductor of the connection object toward a mating contact of the mating connector.

3. The coaxial connector according to claim 2, wherein the ground conductor of the connection object is disposed on the back surface of the flat plate portion of the connection object, and wherein the spring portion serves also as the shell connecting portion.

4. The coaxial connector according to claim 1, wherein the fixing portion fixes the shell contact portion to the second shell portion.

5. The coaxial connector according to claim 1, wherein the shell has an engaging portion adapted to engage with the connection object in a direction in which the connection object extends, and wherein the engaging portion serves also as the positioning portion.

6. The coaxial connector according to claim 1, wherein the shell has a coupling portion coupling together the first shell portion and the second shell portion, and wherein the first shell portion, the second shell portion, and the coupling portion are integrally formed together.

7. The coaxial connector according to claim 1, wherein the shell contact portion is formed with a fitting portion for fitting to the mating shell of the mating connector.

8. A connector unit comprising the coaxial connector according to claim 1 and the connection object.

9. A connector unit comprising the coaxial connector according to claim 1 and the mating connector.

* * * * *